United States Patent [19]

Fujii et al.

[11] 4,170,494

[45] Oct. 9, 1979

[54] SURFACE TREATMENT FOR METAL ACCORDING TO FLUIDIZED BED SYSTEM

[75] Inventors: Sumihide Fujii, Kobe; Hazime Fukinbara, Kakogawa; Katuzi Mizutani, Takasago; Minoru Nishibe; Yoshitomo Ishii, both of Kobe, all of Japan

[73] Assignee: Kobe Steel, Ltd., Kobe, Japan

[21] Appl. No.: 804,259

[22] Filed: Jun. 7, 1977

[30] Foreign Application Priority Data

Jun. 7, 1976 [JP] Japan ..... 51/66912

[51] Int. Cl.[2] ..... B05D 1/24

[52] U.S. Cl. ..... 148/12 B; 165/104 F; 427/185; 427/191; 427/328; 427/398 R; 427/398 A

[58] Field of Search ..... 427/185, 191, 192, 328, 427/329, 376 H, 383 C, 398 R, 398 A, 398 C; 72/47; 148/12 B, 143, 6; 165/104 F

[56] References Cited

U.S. PATENT DOCUMENTS

| | | | |
|---|---|---|---|
| 2,036,615 | 4/1936 | Wean | 427/329 X |
| 2,570,906 | 10/1951 | Alferieff | 427/329 X |
| 3,053,704 | 9/1962 | Munday | 165/104 F |
| 3,226,817 | 1/1966 | Simborg et al. | 427/329 X |
| 3,347,692 | 10/1967 | Young et al. | 427/185 X |
| 3,436,244 | 4/1969 | Yokawonis | 427/192 |
| 3,492,740 | 2/1970 | Geipel et al. | 34/57 |
| 3,519,497 | 7/1970 | Pomey | 148/14 |
| 3,522,936 | 8/1970 | Geipel et al. | 266/3 |
| 3,525,507 | 8/1970 | Geipel et al. | 266/3 |
| 3,550,920 | 12/1970 | Geipel et al. | 263/21 |
| 3,550,922 | 12/1970 | Geipel et al. | 266/3 |
| 3,559,280 | 2/1971 | Mailhoit et al. | 427/329 X |
| 3,615,083 | 10/1971 | Feinman et al. | 266/3 R |
| 3,618,223 | 11/1971 | Geipel et al. | 165/104 F X |
| 3,658,602 | 4/1972 | Pomey | 148/14 |
| 3,718,204 | 2/1973 | Vitelli | 72/201 |
| 3,745,034 | 7/1973 | Smith et al. | 427/192 X |
| 3,811,929 | 5/1974 | Kanetake | 148/14 X |
| 3,925,570 | 12/1975 | Reinke et al. | 427/185 X |
| 3,982,050 | 9/1976 | Kato et al. | 427/181 X |

FOREIGN PATENT DOCUMENTS

| | | | |
|---|---|---|---|
| 670479 | 9/1963 | Canada | 427/185 |

*Primary Examiner*—Shrive P. Beck

*Attorney, Agent, or Firm*—Oblon, Fisher, Spivak, McClelland & Maier

[57] ABSTRACT

The surface of a metal is treated in a fluidized bed system, in which a hot rolled metal is continuously subjected to an in-line treatment to suppress the formation of scale on its surface or to remove the same therefrom, and then is introduced into a gaseous fluidized bed of a non-oxidizing gas, which contains metal or alloy particles having a low melting point, as fluidized particles, so as to bring the hot rolled metal into contact with the fluidized particles. As a result, the fluidized metal particles or alloy particles may be melted and solidified on the surface of the rolled metal to provide a coated layer of a metal or alloy having a low melting point on the surface thereof. In addition, during the surface treatment in the fluidized bed system, a heat treatment such as patenting or cooling may be applied concomitantly in combination therewith.

18 Claims, 10 Drawing Figures

SURFACE TREATMENT FOR METAL ACCORDING TO FLUIDIZED BED SYSTEM

BACKGROUND OF THE INVENTION

1. Field of the Invention

The present invention relates to a surface treatment for a hot rolled metal using a fluidized bed system, in which a hot rolled metal is introduced into a gaseous fluidized bed having a non-oxidizing gas as a fluidizing medium. In addition the present invention relates to a surface treatment of the type described, conducted concomitantly with a patenting or cooling treatment.

2. Description of the Prior Art

In general, steel wire, rod or bar (referred to simply as steel wire rod, hereinafter) may be produced by a hot rolling process, then stored temporarily before delivery to a subsequent secondary working shop, where the steel wire rod is subjected to a descaling treatment such as pickling or the like, and then to a secondary working step such as heat treatment, plastic working or the like. The above manufacturing process, however, poses many formidable problems to be solved. For instance, wire rod produced in a mill shop can be subjected to a rust-preventive treatment to prevent rust on the wire rod during temporary storage or during transporation to the secondary working shop. However, besides the need for a costly rust-preventive agent, difficulties are encountered in positively preventing rust, which in itself gives rise to many problems. It is customary to subject hot-rolled steel wire rod to pickling to remove scales from the surface thereof, prior to the secondary working step. However, the above pickling process necessitates the use of costly equipment, required for preventing environmental pollution and for exhaust liquid treatment. In addition, steel wire rod is often subjected to a pretreatment for drawing, consisting of phosphating, or lime or borax coating, to improve the surface condition so that a lubricating agent can adhere to the surface in a secondary working step. This however, enhances the complexity of the secondary working.

The problems encountered with the secondary working of hot rolled steel wire rod stem from the surface condition of the wire rod, and hence the need persists for a method to improve the quality of the surface of steel wire rod.

Surface treatment of steel wire has generally included hot dipping and electroplating. The hot dipping process necessitates sophisticated techniques to control the thickness of the deposit, in addition to causing problems such as a low yield of the material to be used for hot dipping, and requires a large amount of thermal energy. On the other hand, the electroplating process results in an increase in the manufacturing cost.

Relevant prior art for the present invention is found in U.S. Pat. Nos. 3,560,239, 3,544,351, and 3,742,106, which disclose processes in which a powdered thermoplastic or thermosetting resin is coated on the surface of a substrate such as glass or steel wire or the like in a gaseous fluidized bed. A need, therefore, continues to exist for a method by which the shortcomings of the prior art surface treatment methods on hot rolled metal, particularly steel wire, rod or bar products, can be avoided.

SUMMARY OF THE INVENTION

Accordingly, an object of the present invention is to provide a novel surface treatment for a hot rolled metal by utilizing the heat from hot rolling.

Another object of the present invention is to provide a surface treatment of the type described, which allows a patenting or cooling process to be applied concomitant with the aforesaid surface treatment.

According to the first aspect of the present invention, there is provided a surface treatment for a hot rolled metal, more particularly steel wire, rod, or bar, using a fluidized bed system, in which a hot rolled metal is introduced into a gaseous fluidized bed having a non-oxidizing gas as a fluidizing medium, the aforesaid treatment being characterized by the steps of: introducing a metal immediately after hot rolling into a bed of an inert gas to suppress the formation of scale on the surface of the metal, or into a bed of a reducing gas to remove scale thereon, then introducing the metal into a gaseous fluidized bed containing fluidized metal or alloy particles having a low melting point so as to bring the fluidized particles into contact with the heated metal, so that fluidized particles are melted and solidified on the surface of the metal, thereby forming a coating film of metal or alloy of a low melting point on the surface of the metal.

According to the second aspect of the present invention, a surface treatment as defined in the first aspect of the invention is provided, in which the aforesaid metal is steel wire, rod or bar.

According to the third aspect of the invention, a surface treatment as defined in the second aspect of the invention is provided, in which a coating film of a metal or alloy of a low melting point is formed on the surface of steel wire rod, while the temperature of the fluidized bed is adjusted so as to subject the steel wire rod to patenting or cooling because of contact of the steel wire rod with the fluidized particles, thereby achieving the desired mechanical properties and a fine pearlite structure.

According to the fourth aspect of the invention, a surface treatment as defined in the first aspect of the invention is provided, in which the aforementioned reducing gas is a mixture of hydrogen gas ($H_2$) and nitrogen gas ($N_2$).

According to the fifth aspect of the invention, a surface treatment as defined in the fourth aspect of the invention is provided, wherein the reducing gas is a mixture of $H_2$ gas of 50 to 100% in volume and the balance $N_2$ gas.

According to the sixth aspect of the invention, a surface treatment as defined in the fifth aspect of the invention is provided, wherein the reducing gas is preferably an AX gas of $H_2$ gas of 75% in volume and $N_2$ gas of 25% in volume.

According to the seventh aspect of the invention, a surface treatment as defined in the first aspect of the invention is provided, wherein the metal of a low melting point is one or more metals selected from a group consisting of Al, Zn, Cd, Pb and Sn.

According to the eighth aspect of the invention, a surface treatment as defined in the seventh aspect of the invention is provided, wherein the metal of a low melting point is preferably Zn.

According to the ninth aspect of the present invention, a surface treatment as defined in the first aspect of the invention is provided, wherein the alloy of a low melting point is one or more alloys selected from a group consisting of Al alloys, Zn alloys, Cd alloys, Pb alloys, Cu alloys, and Sn alloys.

According to the tenth aspect of the present invention, a surface treatment as defined in the ninth aspect of the invention is provided, wherein the alloy of a low melting point is preferably Zn alloy.

According to the eleventh aspect of the present invention, a surface treatment as defined in the first aspect of the invention is provided, wherein the fluidized particles further contain at least one member selected from a group consisting of zircon sand ($ZrO_2.SiO_2$), $Al_2O_3$, and $SiO_2$ particles.

According to the twelfth aspect of the invention, a surface treatment as defined in the first aspect of the invention is provided, wherein a non-oxidizing gas serving as a fluidizing medium is $N_2$ gas or other inert gas is employed.

According to the thirteenth aspect of the invention, a surface treatment as defined in the first aspect of the invention is provided, wherein the temperature range of the fluidized bed is between room temperature and the melting point of the metal or alloy having a low melting point.

According to the fourteenth aspect of the invention, a surface treatment as defined in the first aspect of the invention is provided, wherein the temperature of the metal to be treated, when introduced into the fluidized bed, is not less than the melting point of the metal or alloy having a low melting point.

According to the fifteenth aspect of the present invention, a surface treatment as defined in the third aspect of the invention is provided, wherein the temperature range of the fluidized bed is between room temperature and the melting point of the metal or alloy having a low melting point, and the temperature thereof for patenting the steel wire rod is not more than 500° C.

According to the sixteenth aspect of the present invention, a surface treatment as defined in the third aspect of the invention is provided, wherein the temperature of the steel wire rod or bar when introduced into the fluidized bed, is not less than the melting point of the metal or alloy having a low melting point, and the temperature of the steel wire rod, when or before the steel wire rod is introduced into the fluidized bed, is not less than the $Ar_3$ transformation point for completing the pearlite transformation of the wire rod in the fluidized bed.

BRIEF DESCRIPTION OF THE DRAWINGS

FIGS. 5 to 9 are views illustrative of an outline of the apparatus for use in the surface treatment according to the present invention.

Figure 1:
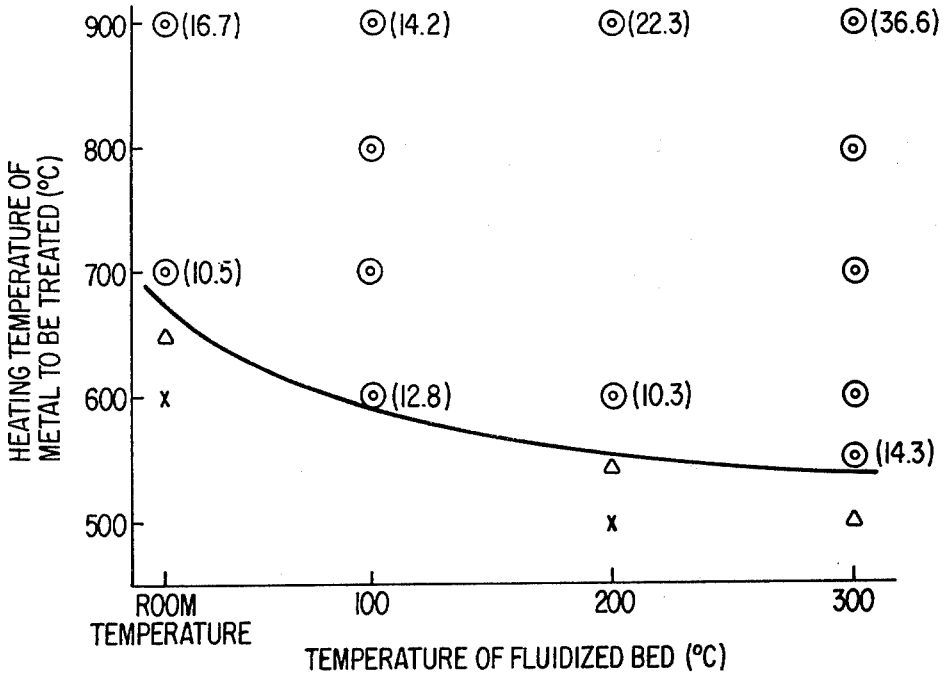
FIG. 1 is a plot illustrative of the relationship between the formation of a Zn coating film and the heating temperature of carbon steel which has been subjected to the surface treatment in a fluidized bed containing fluidized Zn particles, as well as the temperature of the fluidized bed, wherein the symbol ○ represents uniform formation of Zn coating film, Δ represents local formation of Zn coating film, and X represents the absence of Zn coating film, while the numerical figures in parenthesis represent the average thickness (μ) of Zn coating films.

Referenced numerals in FIGS. 4 through 8 designate the following: 1: metal or steel wire rod, 2: pay-off stand, 3: heating and reducing furnace, 6: gaseous fluidized bed, 7: take-up machine, 8: finishing roll, 9: coiling machine, 10: chain conveyor, 11: collector, 12: water cooling zone, 13: water jet scale breaker, 14: pipe or tube for shielding a steel wire rod or bar from atmosphere, 15: shears, 16: water bath.

DETAILED DESCRIPTION OF THE PREFERRED EMBODIMENTS

The conventional manufacturing process of a steel wire rod or bar includes the following steps of:

(1) hot rolling a steel billet into a steel wire rod or bar.

(2) subjecting steel wire rod or bar as-hot-rolled to patenting in a fluidized bed, with forced air cooling or water cooling according to need.

(3) subjecting the steel wire rod or bar to pickling.

(4) pretreatment for drawing, for example, phosphating, the steel wire rod or bar thus treated, and (5) drawing the steel wire rod or bar thus pretreated.

The above steps (1), (2) are carried out at a mill shop, while steps (3), (4) and (5) are carried out at the secondary working shop. The second step (2) may be omitted as required.

The problem posed by the above conventional manufacturing process are as follows:

(A) Considerable rust forms when a hot-rolled steel wire rod is stored for a long period of time before being delivered to a secondary working shop, and the surface quality of the steel wire rod deteriorates.

(B) Pickling is a cause of environmental pollution.

(C) Pretreatment (phosphating) is required, before drawing.

The present invention is directed to solving these technical problems by subjecting a hot-rolled steel wire rod to a surface treatment in a fluidized bed, without using pickling and pretreatment for drawing, before drawing the wire rod. In addition, by adjusting the temperature of the fluidized bed, patenting may be concomitantly carried out in combination with the surface treatment.

A significant feature of the present invention lies in the fact that a heated metal is introduced into a gaseous fluidized bed of a non-oxiding gas serving as a fluidizing medium. More particularly, a metal immediately after hot rolling is introduced into a bed having an inert gas atmosphere to suppress the formation of scale on the surface thereof, or into a bed having a reducing gas atmosphere to remove scale from the surface of the metal, after which the metal is introduced into a gaseous fluidized bed containing metal or alloy particles having a low melting point serving as fluidized particles therein or a gaseous fluidized bed containing a mixture of a metal or alloy having a low melting point with particles of at least one member selected from a group consisting of zircon sand ($ZrO_2.SiO_2$), $Al_2O_3$ and $SiO_2$ particles, as fluidized particles, thereby forming a coating layer of a metal or alloy having a low melting point on the surface of the hot rolled metal. In this respect, the surface treatment of the aforesaid hot rolled metal may be carried out by utilizing rolling heat for a hot rolled metal. Furthermore, in the present invention, by adjusting the temperature of the fluidized bed, a hot rolled metal may be patented or cooled because of its contact with fluidized particles, thereby achieving the desired mechanical properties and structure.

The first feature of the present invention lies in the fact that a heated metal is introduced into a fluidized bed having a non-oxidizing gas such as $N_2$ gas or other inert gas as the fluidizing medium, wherein the fluidized bed contains metal or alloy particles has a low melting point as fluidized particles.

Metal or alloy particles which are used as fluidized particles are fluidized by a fluidizing medium, and then contact the surface of a heated metal introduced into the fluidized bed, thereby melting on the surface of the rolled metal, and then solidifying thereon, as the surface temperature of the rolled metal is lowered. Therefore, the melting point of the metal or alloy particles should be lower than the heating temperature of the rolled metal. The expression "low melting point of the metal or alloy" is used above in this sense. Suitable metals or alloys which are employable in the surface treatment of the invention include:

| Metal, Alloy | Melting point (°C.) |
|---|---|
| Al | 660 |
| Zn | 419 |
| Cd | 329 |
| Pb | 327 |
| Sn | 232 |
| Cu — Sn | 1083–232 |
| Cu — Zn | 1083–419 |
| Pb — Sn | 327–180–232 |
| Pb — Zn | 327–780–419 |
| Sn — Zn | 232–200–419 |
| Al — Zn | 660–380–419 |

Suitable metals having a low melting point which may be employed for the surface treatment of the invention include at least one metal selected from the group consisting of Al, Zn, Cd, Pb, and Sn, and should preferably be Zn, which affords rust-preventive and drawing-lubricating properties. Suitable alloys having a low melting point include at least one alloy selected from the group consisting of Al alloys, Zn alloys, Cd alloys, Pb alloys, Cu alloys and Sn alloys, and should preferably be a Zn alloy which affords rust-preventive and drawing-lubricating properties. The aforesaid metals or alloys having a low melting point may be used singly or in combination. The term metals or alloys having a low melting point should not be construed in a limitative sense.

To insure positive adhesion of fluidized particles to the surface of a rolled metal in a fluidized bed containing fluidized particles, it is mandatory that little or no scale be present on the metal surface. To this end, it is necessary that the rolled metal be introduced into a bed having a non-oxidizing atmosphere (inert atmosphere or reducing atmosphere) or into a vacuum, or that it be subjected to a flux treatment. On the other hand, to prevent oxidation of the rolled metal and fluidized particles, or oxidation of the metal or alloy film on the surface of the rolled metal, a fluidized medium having a non-oxidizing gas atmosphere (inert gas, reducing gas and the like) should be used.

Tests were performed to determine conditions for obtaining a coating of fluidized particles as a function of the thickness of the oxide layer (scale) on the surface of the rolled metal. Samples of carbon steel cooled in air after hot rolling were used. The samples were heated at 900° C. in various kinds of atmospheres such as air, inert gas or reducing gas, after which the samples were introduced into a fluidized bed (temperature of 100° C.) with nitrogen gas serving as the fluidizing medium, wherein the fluidized bed contained Zn particles as fluidized particles, and the extent of Zn coating was observed. The test results reveal that, when the thickness of the oxide layer (FeO, $Fe_3O_4$, or $Fe_2O_3$) is not less than an average of 6$\mu$, there is no formation of Zn coating or film on the surface of the carbon steel. In contrast thereto, when the thickness of the oxide layer is not more than an average of 2$\mu$, a uniform coating or film of Zn can be achieved. It follows from this that the average thickness of the oxide layer on the surface of a steel to be introduced into a fluidized bed should be not more than 2$\mu$, most preferably zero $\mu$.

Adhesion of fluidized particles to a rolled metal requires the melting and solidification of fluidized particles on its surface. As a result, the conditions therefor should accommodate themselves to the melting of fluidized particles on the surface of a rolled metal. This, however, depends on the heating temperature of the rolled metal, the melting points of the fluidized particles, and the temperature of the fluidized bed. In other words, when the heating temperature of the rolled metal is constant, then the higher the temperature of the fluidized bed, the more readily the fluidized particles adhere to the surface of the rolled metal. However, if the temperature of the fluidized bed is too high, then fluidized particles are melted or almost melted before contacting the surface of the rolled metal, resulting in cohesion of the fluidized particles. In the case of fluidized particles having a lower melting point, a lower heating temperature of the metal to be treated, or a fluidized bed at a lower temperature may be used.

Tests were performed to determine the conditions required to achieve a Zn coating using fluidized particles as a function of the temperature of the fluidized bed, as well as the heating temperature of the rolled metal. Carbon steel cooled in air after hot rolling was used for the samples. The samples were heated at 500° C. to 900° C. in a reducing atmosphere to achieve an average thickness of the oxide layer (scale) on the surface of the samples, immediately after which the samples were introduced into the fluidized bed (the temperatures of the fluidized bed run from room temperature to 300° C.) having a fluidizing medium of nitrogen gas, wherein the fluidized bed contained Zn particles as the fluidized particles, and the thickness of the Zn coating was observed. FIG. 1 shows the test results. As can be seen from FIG. 1, formation of a Zn coating depends on the heating temperature of the steel, and on the temperature of the fluidized bed, and unless the temperature of the steel is above the curves shown, a uniform Zn coating may not be formed.

The metal or alloy particles having a low melting point, which are used as fluidized particles in the surface treatment of the invention in a fluidized bed system, may be used in combination with other fluidized particles whose melting point is not markedly lower than that of the former, and which are stable at the operating temperature of the fluidized bed. For instance, sands such as zircon sand ($ZrO_2.SiO_2$) may be used in the heat treatment according to an ordinary fluidized bed.

Suitable such fluidized particles for use in the present invention include:

(1) at least one member selected from the group consisting of zircon sand ($ZrO_2.SiO_2$), $Al_2O_3$, and $SiO_2$ particles serving as fluidized particles to cool hot rolled metal;

(2) metals and/or alloys having a low melting point, as fluidized particles, to coat a rolled metal.

In this respect, the fluidized particles for use in coating may be used alone or a mixture of fluidized particles for cooling and fluidized particles for coating may be used together. In the latter case, as an alternative to using the aforesaid mixture of fluidized particles for cooling and coating, fluidized particles for cooling whose surfaces are coated with fluidized particles for coating may be used. If the thickness of the coating film of a metal or alloy having a low melting point, which is to be coated on the surface of a rolled metal, is desired to be increased, then fluidized particles for coating are used alone. On the contrary, when the thickness of the coating layer is desired to be decreased, then a mixture of fluidized particles for cooling and coating in a suitable mixing ratio is used. In this respect, the fluidized particles for cooling of the present invention should not necessarily be limited to zircon sands, and may also include $SiO_2$, or $Al_2O_3$ particles or mixtures thereof.

A second important feature of the present invention lies in the fact that patenting is applied concomitantly in combination with the surface treatment of a heated rolled metal in the aforesaid fluidized bed.

Hitherto, patenting treatments for steel wire rod according to fluidized beds have been carried out by using zircon sands as fluidized particles. In contrast thereto, according to the present invention, zircon sands are partially or entirely replaced by metal or alloy particles having a low melting point. The metal or alloy particles, unlike zircon sands, withdraw heat from a hot rolled metal as a consequence not only of heat exchange during contact with the latter but also due to the additional latent heat withdrawn when the fluidized particles are melted on the surface of the hot rolled metal. In the case of patenting, the temperature of the fluidized bed should be adjusted.

EXAMPLE

Figure 2:
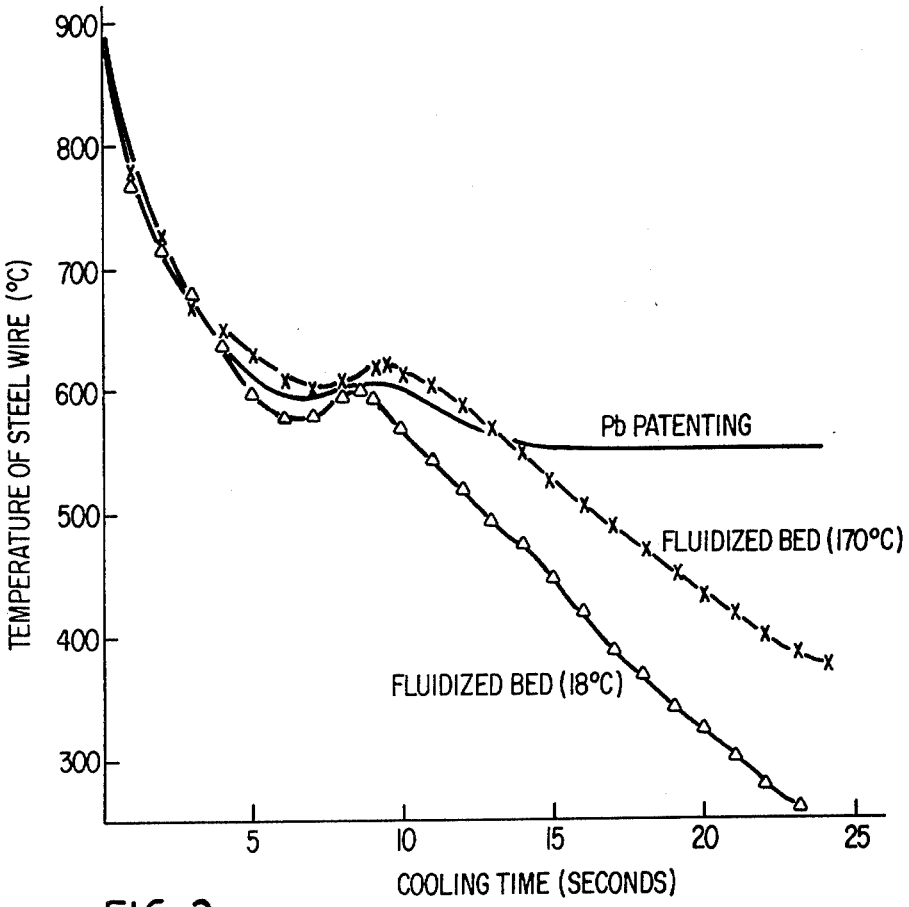
FIG. 2 is a plot showing cooling curves in the surface treatment of a high carbon steel wire rod in a gaseous fluidized bed containing Zn particles as the fluidized particles.

High carbon steel wire rod (0.62% C., 5.5 mm diameter) cooled in the air after hot rolling was used as a sample, and heated at 900° C. Thereafter, the sample was introduced into a fluidized bed having a temperature of 18° C. (room temperature) or 170° C., which used nitrogen gas as a fluidizing medium, wherein the fluidized bed contained Zn particles as fluidized particles (average—100 mesh). Then, the continuous cooling curve for the rod was prepared. As shown in FIG. 2, the cooling curve for a wire rod in a fluidized bed containing Zn particles as fluidized particles exhibits a similarly shaped cooling curve to that shown in lead patenting, up to a transformation point in the neighborhood of 600° C., suggesting the possibility of a patenting treatment for a high carbon steel wire rod. Needless to say, other heat treatments, such as ordinary cooling, are possible by varing the type of fluidized particles, the temperature of the fluidized bed, and the like.

In this manner, the desired mechanical properties and a fine pearlite structure may be obtained.

A third noteworthy feature of the present invention lies in the fact that both the aforesaid surface treatment and the patenting treatment may be carried out by utilizing the heat retained by hot rolled metal. This may be attributed to a low resistance in passing through the fluidized bed and to the feasibility of easily immersing a rolled metal in the fluidized bed.

Figure 10:
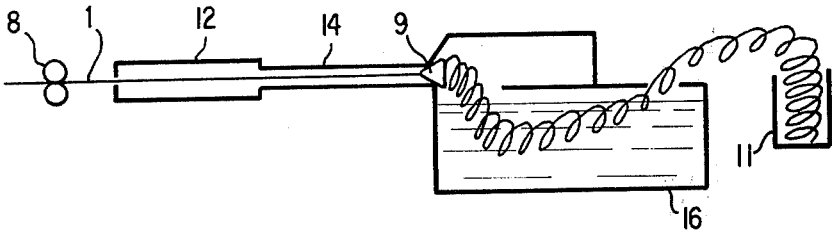

The problem in the aforesaid surface treatment of a hot rolled metal is scale which is formed on the surface of the metal during or after the hot rolling. FIG. 10 shows the results of scale produced during the hot rolling process of a steel wire rod. In this test, samples were passed through a water cooling zone 12, and then through a loop layer 9 in a $N_2$ gas atmosphere, after which the samples were cooled with water in a water bath to suppress the formation of scale. The thickness of scale was found to average about 4$\mu$ or more, based on the data thus obtained. The thickness of scale immediately after hot rolling, i.e., immediately after exiting from a finishing roll is estimated to fall in a range of about 2 to 3$\mu$.

Accordingly, when the surface treatment is carried out by utilizing heat retained by a hot rolled steel wire rod, it is mandatory to suppress the formation of scale on the surface of the hot rolled metal or to remove scale therefrom.

Measures for suppressing scale formation or removing the scale on the surface of a hot rolled metal include physical and chemical treatments. The inventors' study reveals that a hot rolled metal should be soaked in an inert gas atmosphere or a reducing gas atmosphere, while the rolled metal travels from a finishing roll into a fluidized bed.

Description will be given of the results of the aforesaid reducing treatment. High carbon steel wire rods, with an average thickness of scale of 10$\mu$, which were cooled in the air after hot rolling, and having scale in an amount of 0.375% (40.84 g/m$^2$) were used as samples.

Figure 3:
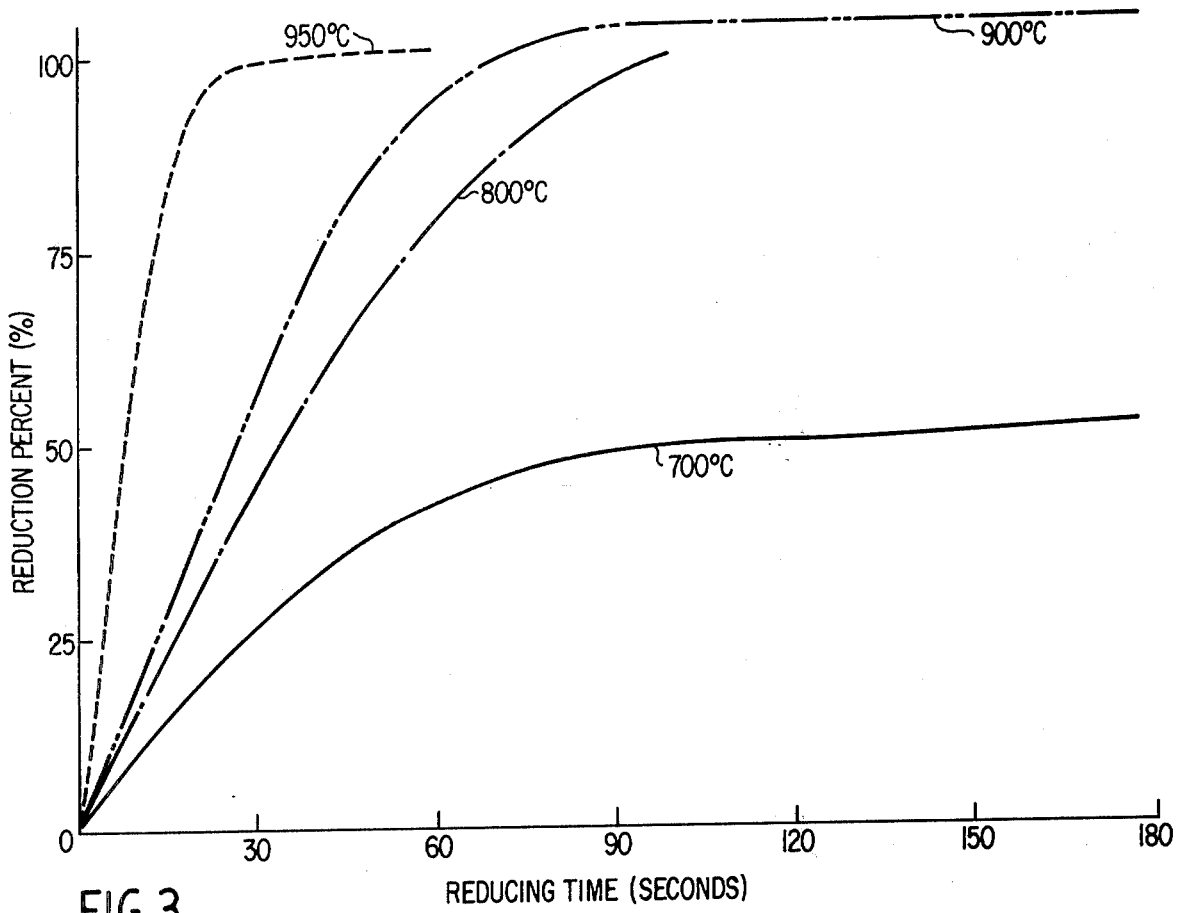
FIG. 3 is a plot showing the relationship between the reducing time and the reduction percent in the hydrogen reduction of a high carbon steel wire rod having scale thereon.

Samples were subjected to a reducing treatment at temperatures of 700° to 950° C. in a pure hydrogen atmosphere. FIG. 3 shows the relationship between the reducing time and the reduced amount of scale on the surface of the samples at varying reducing temperatures. Samples treated at 900° C. for 60 seconds, as shown in FIG. 3, provided surfaces of a silver color, and scale was removed almost in its entirety. The samples treated at 700° C. for 180 seconds provided surfaces of a white color, without gloss, the surfaces did not possess an FeO, $Fe_3O_4$, or $Fe_2O_3$ layer. Thus, the samples treated at 700° C. for 180 seconds are considered to be adapted to surface coating by Zn fluidized particles in a fluidized bed. It may be concluded therefrom that surface coating by fluidized particles is possible following a hydrogen-reducing treatment for 10 seconds at 950° C. (the temperature at the completion of hot rolling), for samples which have scale of a thickness of about 10$\mu$.

The reducing gases which may be recommended for the treatment of the invention are 50 to 100% by volume of $H_2$ gas and the balance $N_2$ gas, in the light of the reduced amount (reduction in weight) of scale on the surface of a hot rolled metal in a reducing atmosphere and the temperature of a hot rolled metal in a reducing atmosphere. An industrial gas which may be preferably employed is so-called AX gas, consisting of 75% by volume of $H_2$ gas and 25% by volume of $N_2$ gas.

Alternatively, immediately after hot rolling and before the metal is introduced into a bed having a reducing gas atmosphere, the hot rolled metal may be introduced into at least one of a bed of non-oxidizing gas such as $N_2$ gas or other inert gases, a water cooling zone, or a water jet scale breaker, thereby suppressing the formation of scale on the surface of the hot rolled metal beforehand, after which the hot rolled metal may be advantageously subjected to reduction.

Figure 4:
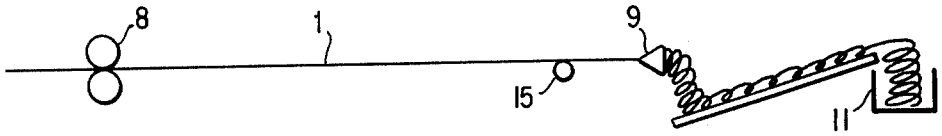
FIGS. 4 to 10 are views illustrative of a hot rolling line for steel wire rod.

A description will now be given of the water jet scale breaking step. As shown in FIG. 4, a high pressure injection nozzle is positioned in the neighborhood of a loop layer 9, and injects high pressure water to a steel wire rod under a pressure of about 50 kg/cm$^2$ to remove scale. The test results show that the thickness of scale is less than about 1$\mu$, proving the effectiveness of the above nozzle.

Now, a description will be given of the apparatus which practices the surface treatment according to the present invention.

Figure 5:
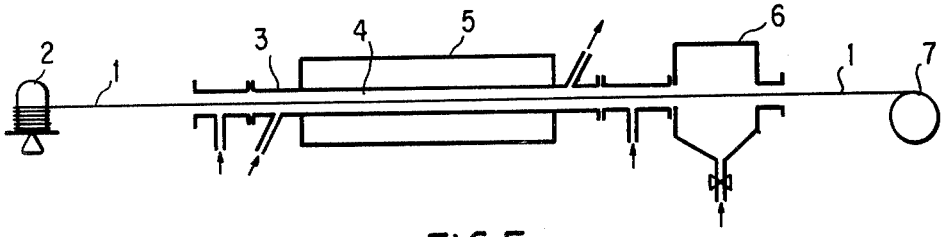

FIG. 5 shows an apparatus for carrying out a surface treatment or a patenting treatment according to a fluidized bed system. As shown, a hot rolled metal 1 is paid out from a pay-off stand 2 so as to be introduced into a heating and reducing furnace 3. The heating and reducing oven 3 consists of a reducing furnace 4 surrounded by a heating furnace 5. The hot rolled metal which has been heated and reduced at a given temperature in the heating and reducing furnace 3 is then introduced into a fluidized bed 6 containing metal or alloy particles of a low melting point as fluidized particles. $N_2$ gas is introduced from the bottom of the fluidized bed 6 so as to fluidize the metal or alloy particles introduced. The hot rolled metal 1 which has been subjected to a surface treatment in the fluidized bed 6, or patented by adjusting the temperature of the fluidized bed is then taken up by a take up machine 7.

Figure 6:
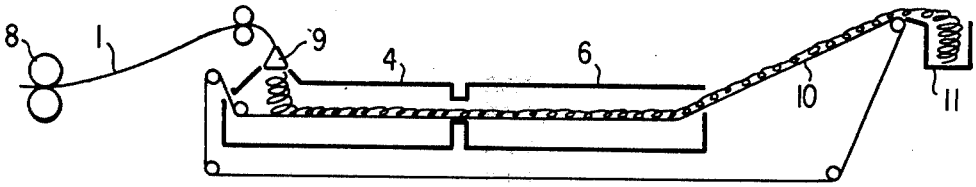

FIGS. 6 to 9 show alternative designs for apparatus for the surface treatment or patenting of a hot rolled metal according to the fluidized bed system. As shown in FIG. 6, the wire rod 1 from a finishing roll 8 is then wound into a loop form in a loop layer 9 and then carried on a chain conveyor 10 through a reducing furnace 4 and a fluidized bed 6. The wire rod 1 in a loop form is reduced in a reducing furnace, then fed to the fluidized bed 6 for the surface treatment and/or heat treatment such as patenting or cooling. The wire rod 1 which has completed the treatment, is then collected in a collector 11.

Figure 7:
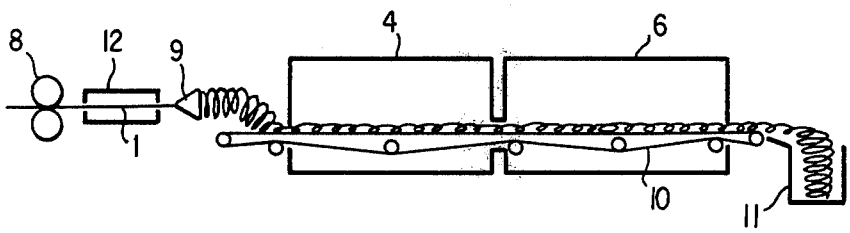

As shown in FIG. 7, the wire rod 1 from the finishing roll 8 is cooled somewhat in a water cooling zone 12, then formed into a loop in a loop layer 9, and then carried on a chain conveyor 10 through a reducing furnace 4, and a fluidized bed 6. The wire rod which has completed the treatment is collected in a collector 11. When a high carbon steel wire rod is treated in this apparatus, the wire rod is cooled in the water cooling zone 12 to a temperature of 600° C. to 800° C., thereby limiting the temperature of the wire rod entering from the loop layer 9 into the reducing furnace 4. Then, the wire rod is reduced with hydrogen in the reducing furnace 4 at a relatively low temperature, and then subjected to the surface treatment as well as cooling in the fluidized bed 6 for simultaneous heat treatment or patenting.

Figure 8:
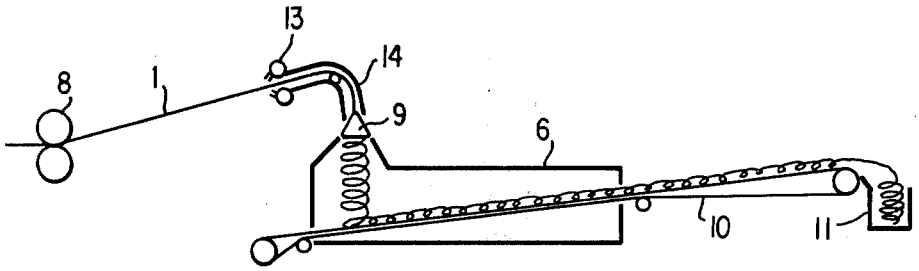

As shown in FIG. 8, the wire rod 1 from the finishing roll 8 is first descaled by a water jet scale breaker 13, then fed through a pipe or tube which shields the steel wire rod from the atmosphere, then formed into loops in the loop layer 9, then carried on a chain conveyor 10 into the fluidized bed 6, and eventually collected in a collector 11.

Figure 9:
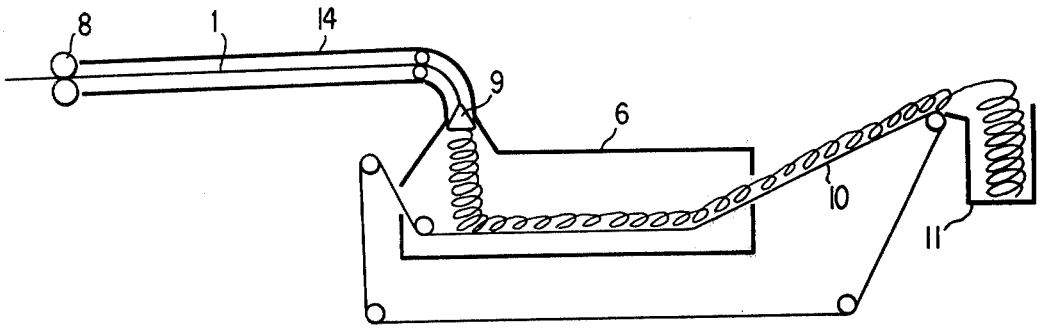

In the embodiment shown in FIG. 9, the steel wire rod 1 from the finishing roll 8 is passed through a pipe or tube which shields the steel wire rod from the atmosphere by means of an inert gas or reducing gas, whereby the formation of scale thereon is suppressed or scale is removed, then formed into a loop in the loop layer 9, introduced into a fluidized bed 6, then carried on the chain conveyor 10 and eventually collected in a collector 11.

On the other hand, in the surface treatment or patenting utilizing the heat retained by a hot rolled steel wire rod, the steel wire rod is not formed into a coil as shown in FIGS. 4 and 6 to 9, thus affording greater ease of treatment as compared with the treatment of a coiled wire rod.

The process according to the present invention allows the surface treatment of a wire rod according to a fluidized bed system in place of hot dipping, electroplating and the like. Thus, the surface treatment according to the present invention may be directly applied to the surface treatment of a hot rolled metal, with the accompanying positive rust preventive treatment which has been a problem in hot rolling processes. In addition, the present invention provides many advantages when combined with secondary working in the manufacture of steel wire. For instance, when steel wire rod with a Zn or Pb coating according to the present invention is used for drawing, then a pretreatment before drawing such as a phosphating treatment may be dispensed with. In addition, according to the process of the invention, both the surface treatment and the patenting may be carried out in combination, so that both the surface quality and the internal structure may be improved at the same time. The surface treatment according to the present invention is well adapted for use in wire rod, and may be applied to the surface treatment of other types of strip materials.

As has been described earlier, in the surface treatment according to a fluidized bed system of the invention, particles are fluidized by a fluidizing medium of a non-oxidizing gas. Accordingly, when steel wire rod is subjected to the surface treatment in a fluidized bed, the temperature of the fluidized bed should span the range from room temperature to the melting point of the metal or alloy having a low melting point, and in addition, the fluidized particles should melt and solidify on the surface of the wire rod in the fluidized bed so as to provide a coating of the metal or alloy having a low melting point of the surface of the wire rod. Accordingly, the temperature of the wire rod, when introduced into the fluidized bed, should be not less than the melting point of the metal or alloy having a low melting point.

Furthermore, a metal, particularly steel wire rod may be subjected not only to a surface treatment but also to a concomitant patenting treatment in a fluidized bed, and the temperature range of the fluidized bed should be not less than the melting point of the metal or alloy having a low melting point, and yet should be not more than 500° C. for patenting the steel wire rod. In addition, the temperature of the steel wire rod when entering the fluidized bed should be not less than the melting point of the metal or alloy having a low melting point. Furthermore, the temperature of the steel wire rod, at or before the time it is introduced into the fluidized bed, should be not less than the Ar3 transformation point, in order to complete the pearlite transformation in the fluidized bed.

A description of several examples of the surface treatment according to the present invention will be presented. In these examples, however, the metal was not directly introduced into a reducing gas atmosphere immediately after hot rolling, and then into the fluidized bed. In other words, the data obtained herein are not in-line data. More specifically, according to the present invention, a metal immediately after hot rolling is wound into a coil form and is cooled in the air, and then introduced past a pay-off stand into a heating and reducing furnace having a reducing gas atmosphere, and then into a fluidized bed. Accordingly, off-line data may be presented. The use of a heating and reducing furnace as a bed with a reducing gas atmosphere, and heating of the wire rod is intended to keep the temperature of the wire rod at an ordinary rolling temperature (850° to 1100° C.) in an in-line condition. Accordingly, the only difference between the in-line and off-line conditions is the linear velocity of the metal i.e., the steel wire rod. The linear velocity of steel wire rod according to in-line treatment generally ranges from 30 to 80 m/sec.

In the following examples, the apparatus shown in FIG. 5 is used.

EXAMPLE 1

In this case, a steel wire rod is taken up, and reduced, followed by a surface treatment in a fluidized bed:

(1) Material to be coated:

Carbon steel wire rod having a diameter of 5.5 mm, which has been taken up immediately after hot rolling, and cooled in the air.

Amount of scale produced on the surface: 60 g/m$^2$
Average thickness of scale: about 10 μm

| | Steel composition (wt %) | | | | | | | | |
|---|---|---|---|---|---|---|---|---|---|
| JIS | C | Mn | Si | P | S | Cu | Ni | Cr | Al |
| SWRH62A | 0.62 | 0.53 | 0.28 | 0.030 | 0.027 | 0.01 | 0.01 | 0.02 | 0.006 |

| | | |
|---|---|---|
| (2) | Heating and reducing conditions: | |
| | Heating and reducing temperature | 900° C. |
| | Heating and reducing time | 5 minutes |
| | Reducing gas atmosphere | AX gas (75 vol % $H_2$ gas + 25 vol % $N_2$ gas) |
| (3) | Fluidized bed treating conditions: | |
| | fluidized particles | Zn particles (100 mesh and under) |
| | fluidizing medium | $N_2$ gas |
| | temperature of fluidized bed | room temperature (18° C.) |
| | soaking time | 30 seconds |
| | linear velocity | 2 m/min. |

A carbon steel wire rod having scale thereon was reduced and subjected to the surface treatment. A thin Zn coating film was formed on the surface of the wire rod, (average thickness of the Zn coating is 17μ, and the amount of Zn in the coating was 120 g/m$^2$) and exhibited a gray white color without gloss. The Zn coating tightly adhered to the surface of the steel wire rod, and did not peel when bent or during drawing.

EXAMPLE 2

In this case, a steel wire rod was taken up, reduced and subjected to a surface treatment in a fluidized bed:

(1) Material to be coated:

A carbon steel wire rod having a diameter of 5.5 mm which has been taken up immediately after hot rolling, and cooled in the air.

| | |
|---|---|
| Amount of scale formed on the surface of the rod | 68 g/m$^2$ |
| Average thickness of scale | about 12μ |

| | Steel composition (wt %) | | | | | | | | |
|---|---|---|---|---|---|---|---|---|---|
| JIS | C | Mn | Si | P | S | Cu | Ni | Cr | Al |
| SWRM6 | 0.06 | 0.30 | 0.01 | 0.008 | 0.024 | 0.01 | 0.02 | 0.02 | trace |

| | | |
|---|---|---|
| (2) | Heating and reducing conditions: | |
| | Heating and reducing temperature | 900° C. |
| | Heating and reducing time | 5 minutes |
| | Reducing gas atmosphere | 100% $H_2$ gas |
| (3) | Fluidized bed treating conditions: | |
| | fluidizing particles | Zn particles (100 mesh and under) |
| | fluidizing medium | $N_2$ gas |
| | fluidizing medium flow. velocity | 7 cm/sec |
| | fluidized bed temperature | 150° C. |
| | soaking time | 30 seconds |
| | linear velocity | 2 m/min |

Carbon steel wire rod having scale thereon was reduced and subjected to the surface treatment under the above conditions. A thin Zn coating was formed on the surface of the wire rod thus obtained, (the average thickness of Zn coating was 3μ; the amount of Zn attached was 22 g/m$^2$). The Zn coating tightly adhered to the surface of the wire rod.

EXAMPLE 3

A steel wire rod was taken up, reduced, and subjected not only to a surface treatment but also to patenting in a fluidized bed:

(1) Material to be coated:

Carbon steel wire rod having a diameter of 5.5 mm, which has been taken up immediately after hot rolling and cooled in the air.

| | |
|---|---|
| Amount of scale formed on the surface of the rod | 45 g/m$^2$ |
| Average thickness of scale | about 8μ |

| | Steel composition (Wt %) | | | | | | | | |
|---|---|---|---|---|---|---|---|---|---|
| JIS | C | Mn | Si | P | S | Cu | Ni | Cr | Al |
| SWRH62A | 0.62 | 0.53 | 0.28 | 0.030 | 0.027 | 0.01 | 0.01 | 0.02 | 0.006 |

| | |
|---|---|
| (2) Heating and reducing conditions: | |
| heating and reducing temperature | 900° C. |
| heating and reducing time | 30 seconds |
| reducing gas atmosphere | AX gas (75% vol % $H_2$ gas + 25 vol % $N_2$ gas) |
| (3) Fluidized bed treating conditions: | |
| fluidized particles | Zn particles (100 mesh and under) |
| fluidizing medium | $N_2$ gas |
| fluidizing medium flow velocity | 10 cm/sec |
| fluidized bed temperature | 160° C. |
| 'soaking time | 30 seconds |
| linear velocity | 2 m/min |

Carbon steel wire rod having scale thereon was reduced under the above conditions and subjected to the surface treatment and patenting in the fluidized bed.

A thin Zn film was formed on the surface of the steel wire rod, (the average thickness of Zn film was 20μ; the amount of Zn deposited was 140 g/m$^2$), and exhibited a gray white color, without gloss. The Zn film tightly adhered to the surface of the steel wire rod and did not peel when bent or during drawing. In addition, the internal structure of the wire rod after the treatment exhibited a fine pearlite structure. The mechanical properties of the wire rod after the surface treatment and the patenting but prior to drawing was such that the tensile strength was 109.6 kg/mm$^2$, the elongation was 6.5%, and the reduction of area was 49.8%.

EXAMPLE 4

In this case, a steel wire rod was taken up, reduced and subjected not only to a surface treatment but also to patenting in combination:

(1) Material to be coated:

A carbon steel wire rod having a diameter of 5.5 mm, which was taken up immediately after hot rolling, and cooled in the air.

| | |
|---|---|
| Amount of scale formed on the surface of the rod | 48 g/m$^2$ |
| Average thickness of scale | about 8.5μ |

| | Steel composition (wt %) | | | | | | | | |
|---|---|---|---|---|---|---|---|---|---|
| JIS | C | Mn | Si | P | S | Cu | Ni | Cr | Al |
| SWRH72B | 0.73 | 0.74 | 0.24 | 0.010 | 0.017 | 0.01 | 0.01 | 0.03 | 0.006 |

| | |
|---|---|
| (2) Heating and reducing conditions: | |
| Heating and reducing temperatures | 900° C. |
| Heating and reducing time | 5 or 10 minutes |
| Reducing gas atmosphere | 100% $H_2$ gas |
| (3) Fluidized bed treating conditions: | |
| Fluidized particles | Zircon sand + Zn particles (10.8 wt% Zn, balance, zircon sand) |
| Zircon sand | average 150 mesh |
| Zn particles | 100 mesh and under |

| | Chemical composition of zircon sand (wt %) | | | | | |
|---|---|---|---|---|---|---|
| $ZrO_2$ | $SiO_2$ | $Fe_2O_3$ | $TiO_2$ | P .. | $Al_2O_3$ | Ignition Loss |
| 61.90 | 33.00 | 0.137 | 0.51 | 0.17 | 0.31 | 0.50 |

| | |
|---|---|
| Fluidizing medium | $N_2$ gas |
| Fluidizing medium flow velocity | 7 cm/sec, 10 cm/sec, 14 cm/sec |
| Fluidized bed temperature | 150° C. |
| Soaking time | 30 or 60 seconds |
| Linear velocity | 1 m/min, 2 m/min |

Carbon steel wire rods having scale thereon were reduced under the above conditions, and subjected not only to the surface treatment but also to patenting in combination.

A thin Zn film was formed on the surface of the wire rod thus obtained, and it exhibited a gray white color, without gloss. The Zn film tightly adhered to the surface of the rod; and did not peel during drawing. In addition, the internal structure of the wire rod after the treatment exhibited a fine pearlite structure. The mechanical properties of the wire rod after the surface treatment and the patenting but prior to drawing are as shown in the following table, proving that the surface treatment and patenting were carried out successfully at the same time.

| Sample No. | heating and reducing time (min) | fluidizing medium flow velocity (cm/sec) | linear velocity (m/min) | soaking time (sec) | average thickness of Zn film (μ) | amount of Zn film deposited ($g/m^2$) | yield point ($kg/mm^2$) | tensile strength ($kg/mm^2$) | elongation (%) | reduction in area (%) |
|---|---|---|---|---|---|---|---|---|---|---|
| A | 5 | 7 | 2 | 30 | 5 | 37 | 79.7 | 118.4 | 6.9 | 45.7 |
| B | 5 | 10 | 2 | 30 | 4 | 28 | 78.9 | 118.6 | 6.8 | 45.7 |
| C | 5 | 14 | 2 | 30 | 5 | 34 | 82.6 | 120.9 | 6.6 | 44.0 |
| D | 10 | 7 | 1 | 60 | 7 | 49 | 75.4 | 113.6 | 5.1 | 40.8 |
| E | 10 | 10 | 1 | 60 | 7 | 50 | 80.2 | 116.8 | 4.8 | 39.0 |
| F | 10 | 14 | 1 | 60 | 7 | 51 | 84.4 | 121.9 | 5.9 | 40.8 |

With the aforesaid embodiments, Zn particles are used as the metal having a low melting point. Alternatively, according to the present invention, both the surface treatment and the patenting treatment may be carried out in combination by using other metals and alloys having a low melting point in the same manner as Zn particles.

What is claimed as new and intended to be covered by Letters Patent is:

1. A method of coating hot-rolled steel wire, rod or bar with concomitant patenting or other controlled cooling, which comprises the step of introducing steel wire, rod or bar after hot rolling into a fluidized bed having a non-oxidizing gas as a fluidizing medium and containing fluidized metal or alloy particles having a low melting point to contact said steel wire, rod or bar with said fluidizied metal or alloy particles so that said fluidized metal or alloy particles melt and solidify on the surface of said steel wire, rod or bar, thereby forming a coating of said metal or alloy having a low melting point on the surface of said steel wire, rod or bar, and concomitantly effecting a phase transformation of said steel wire, rod or bar in said fluidized bed; wherein the temperature of said steel wire, rod or bar when introduced into said fluidized bed is not less than the melting point of said metal or alloy having a low melting point.

2. The method of claim 1, wherein said coating of a metal or alloy having a low melting point is formed on the surface of said steel wire, rod, or bar, while said steel wire, rod, or bar is concomitantly subjected to patenting by bringing said fluidized particles in contact with said steel wire, rod, or bar, in a temperature adjusted fluidized bed, thereby achieving the desired mechanical properties and a fine pearlite structure of said steel wire, rod, or bar.

3. The method of claim 2, wherein the temperature range of said temperature adjusted fluidized bed for patenting said steel wire, rod, or bar is between room temperature and just below the melting point of said metal or alloy having a low melting point, and is not more than 500° C.

4. The method of claim 3, wherein the temperature of said temperature adjusted fluidized bed is from 18° to 170° C.

5. The method of claim 2, wherein the temperature of said steel wire, rod, or bar at or before the time said steel wire, rod, or bar is introduced into said temperature adjusted fluidized bed, is not less than the Ar3 transformation point, to allow said steel wire, rod, or bar to complete the pearlite transformation in said temperature adjusted fluidized bed.

6. The method of claim 1, wherein said metal having a low melting point is at least one metal selected from the group consisting of Al, Zn, Cd, Pb and Sn.

7. The method of claim 6, wherein said metal having a low melting point is Zn.

8. The method of claim 1, wherein said alloy having a low melting point is at least one alloy selected from the group consisting of Al alloys, Zn alloys, Cd alloys, Pb alloys, Cu alloys, and Sn alloys.

9. The method of claim 8, wherein said alloy having a low melting point is Zn alloy.

10. The method of claim 1, wherein said fluidized particles further include at least one member selected from the group consisting of zircon sand ($ZrO_2.SiO_2$), $Al_2O_3$ and $SiO_2$ particles.

11. The method of claim 1, wherein said non-oxidizing gas serving as a fluidizing medium is $N_2$ gas or another inert gas.

12. The method of claim 1, wherein the temperature of said fluidized bed ranges from room temperature to just below the melting point of said metal or alloy having a low melting point.

13. The method of claim 1, wherein said steel wire, rod or bar is introduced immediately after hot rolling into at least one of (a) an inert gas atmosphere, a water cooling zone, or a water jet scale breaker to suppress the formation of scale on its surface and (b) a reducing gas atmosphere to remove scale on its surface, and the resultant low scale steel wire, rod or bar is then introduced into said fluidized bed.

14. The method of claim 13, wherein said reducing gas is a mixture of $H_2$ gas and $N_2$ gas.

15. The method of claim 14, wherein said reducing gas is a mixture of 50 to 100% by volume of $H_2$ gas and the balance $N_2$ gas.

16. The method of claim 3, wherein said reducing gas is an AX gas consisting of about 75% by volume of $H_2$ gas and about 25% by volume of $N_2$ gas.

17. The method of claim 13, wherein said steel wire, rod or bar has from 0μ to about 2μ average thickness of oxide layer on its surface when introduced into said fluidized bed.

18. The method of claim 1, wherein said metal or alloy particles having a low melting point are selected from the group consisting of zircon sand ($ZrO_2.SiO_2$), $Al_2O_3$ and $SiO_2$ particles, each of which is coated with a metal or alloy having a low melting point.

* * * * *